US011338888B2

(12) United States Patent
Mazzarelli

(10) Patent No.: US 11,338,888 B2
(45) Date of Patent: May 24, 2022

(54) COVER FOR PONTOON BOAT

(71) Applicant: Commercial Sewing, Inc., Torrington, CT (US)

(72) Inventor: David Mazzarelli, Torrington, CT (US)

(73) Assignee: COMMERCIAL SEWING, INC., Torrington, CT (US)

( * ) Notice: Subject to any disclaimer, the term of this patent is extended or adjusted under 35 U.S.C. 154(b) by 0 days.

(21) Appl. No.: 16/845,898

(22) Filed: Apr. 10, 2020

(65) Prior Publication Data

US 2020/0324861 A1 Oct. 15, 2020

Related U.S. Application Data

(60) Provisional application No. 62/832,047, filed on Apr. 10, 2019.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS 2,536,152 A * 1/1951 Bass ..... B63B 17/02 114/361
2,732,877 A * 1/1956 Taylor ..... B63B 17/02 114/361
D226,684 S 4/1973 Beyer
D315,138 S 3/1991 Simpkins, Sr. et al.
5,228,408 A * 7/1993 Jannausch ..... B63B 17/02 114/361
5,564,358 A * 10/1996 Newton ..... B63B 59/02 114/361
5,813,360 A * 9/1998 Dickey, Jr. ..... B63B 17/02 114/161
D416,852 S 11/1999 Clarke
6,129,034 A * 10/2000 Santa Cruz ..... B63B 17/02 114/361
6,209,477 B1 4/2001 Biedenweg
6,260,505 B1 7/2001 Polidan
6,978,732 B1 12/2005 Jirak
D516,495 S 3/2006 Menne
7,484,472 B1 2/2009 Highfield
7,555,994 B1 * 7/2009 Arnall ..... B63B 17/02 114/361
8,066,318 B2 11/2011 Mazzarelli et al.
(Continued)

OTHER PUBLICATIONS

Mazzarelli et al.; U.S. Appl. No. 15/200,152, filed Jul. 1, 2016; Cover for Cargo in Transit and Device for Securing a Cover to Cargo.

(Continued)

*Primary Examiner* — Lars A Olson
(74) *Attorney, Agent, or Firm* — Cantor Colburn LLP

(57) ABSTRACT

A cover assembly for a watercraft comprising a cover body having a front end, an air dam, and two lateral sides, wherein a non-uniform arch is formed at one of the lateral sides longitudinal to a direction of air flow. In addition, the non-uniform arch has a front portion having a radius between 400 inches to 300 inches, a back having a radius between 100 inches to 50 inches, and a central portion having a radius at least greater than 1000 inches.

13 Claims, 9 Drawing Sheets

(56) References Cited

U.S. PATENT DOCUMENTS

| | | | | |
|---|---|---|---|---|
| 8,875,646 | B2 * | 11/2014 | Zirkelbach | B63B 17/02 114/361 |
| 9,120,539 | B1 | 9/2015 | Binder | |
| 9,708,034 | B2 | 7/2017 | Stier | |
| 9,718,517 | B2 | 8/2017 | Zirkelbach et al. | |
| D798,793 | S | 10/2017 | Hoover Fenton | |
| D868,666 | S | 12/2019 | Zolotuhin | |
| 2007/0095271 | A1 * | 5/2007 | Yang | B63B 17/02 114/361 |
| 2015/0166144 | A1 * | 6/2015 | Langley | B63B 17/02 114/361 |

OTHER PUBLICATIONS

Pontoon and Deck Boat; "Ameritex Introduces Two New Snapless Pontoon Covers"; Dec. 2015; Retrieved from Internet Apr. 9, 2020 https://www.pdbmagazine.com/2015/12/ameritex-introduces-two-new-snapless; 9 pages.

U.S. Restriction Requirement; U.S. Appl. No. 29/731,045; dated Oct. 8, 2021; 10 pages.

U.S. Restriction Requirement; U.S. Appl. No. 29/731,044; dated Oct. 8, 2021; 14 pages.

* cited by examiner

COVER FOR PONTOON BOAT

BACKGROUND

Exemplary embodiments of the present disclosure relate to a cover for a boat, and more particularly, to a cover for use with a pontoon boat.

It is well known to provide a boat with a cover to prevent water and other debris from collecting inside the boat when the boat is not in use. In many instances, boats utilize covers designed to be affixed to the boat via a plurality of snaps or other affixing mechanisms. The snap members are spaced about the entire perimeter of the cover to effect affixation thereof. For example, pontoon boats typically include a plurality of snap members affixed to the outboard side of the rails forming the perimeter fencing of the pontoon boat. Covers of this type are relatively difficult to place in operative position.

In addition, the cover also serves to provide improved drag efficiencies during trailering of the boat. Unfortunately, conventional covers often allow incoming air flow to enter into and under the boat cover, increasing drag and hindering gas efficiencies and related performance. Moreover, conventional covers will buffet during trailering, often causing damage to the cover itself, as well as, the boat.

Hence, what is needed is an improved boat cover, providing ease of use and improved performance.

BRIEF SUMMARY

According to an embodiment a cover assembly for a watercraft comprising a cover body having an air dam, a rear end, and two lateral sides, wherein a non-uniform arch is formed at one of the lateral sides longitudinal to a direction of air flow is provided. In addition, the non-uniform arch has a front portion having a radius between 400 inches to 300 inches, a rear portion having a radius between 100 inches to 50 inches, and a central portion having a radius at least greater than 1000 inches In addition to one or more of the features described above, or as an alternative, in further embodiments wherein the radius at the back of the arch is selected to allow a flow of air to pass over the arch without being drawn into the cover.

In addition to one or more of the features described above, or as an alternative, in further embodiments wherein the air dam restricts the air flow into the cover.

In addition to one or more of the features described above, or as an alternative, in further embodiments further comprising an affixing system associated with the cover body, the affixing system including a tension strap mounted at a hem of the cover body and a tension mechanism for selectively applying tension to the tension strap.

In addition to one or more of the features described above, or as an alternative, in further embodiments wherein the affixing system further comprises a fastener slidably mounted to the tension strap, the fastener being removably connectable to a fixture of the watercraft.

In addition to one or more of the features described above, or as an alternative, in further embodiments wherein the hem of the cover body includes a plurality of pockets, the tension strap extending through the plurality of pockets.

In addition to one or more of the features described above, or as an alternative, in further embodiments wherein the fastener is disposed about the tension strap at an opening defined between two adjacent pockets of the plurality of pockets.

In addition to one or more of the features described above, or as an alternative, in further embodiments wherein the tension mechanism is a ratchet.

In addition to one or more of the features described above, or as an alternative, in further embodiments wherein the affixing system further comprises at least one connector mounted to the cover body, the at least one connector being removably connectable to a hull of the watercraft.

According to a further embodiment, a cover assembly for a watercraft is provided comprising a cover body having a front air dam and a non-uniform arch on a side longitudinal to a direction of air flow, wherein the non-uniform arch has a front end, central portion and back to facilitate the air flow to be removed from the cover body and create a low pressure environment inside the cover body during trailering, wherein the cover body has a transition angle between the air dam and the front end of the non-uniform arch of between 25 and 45 degrees.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
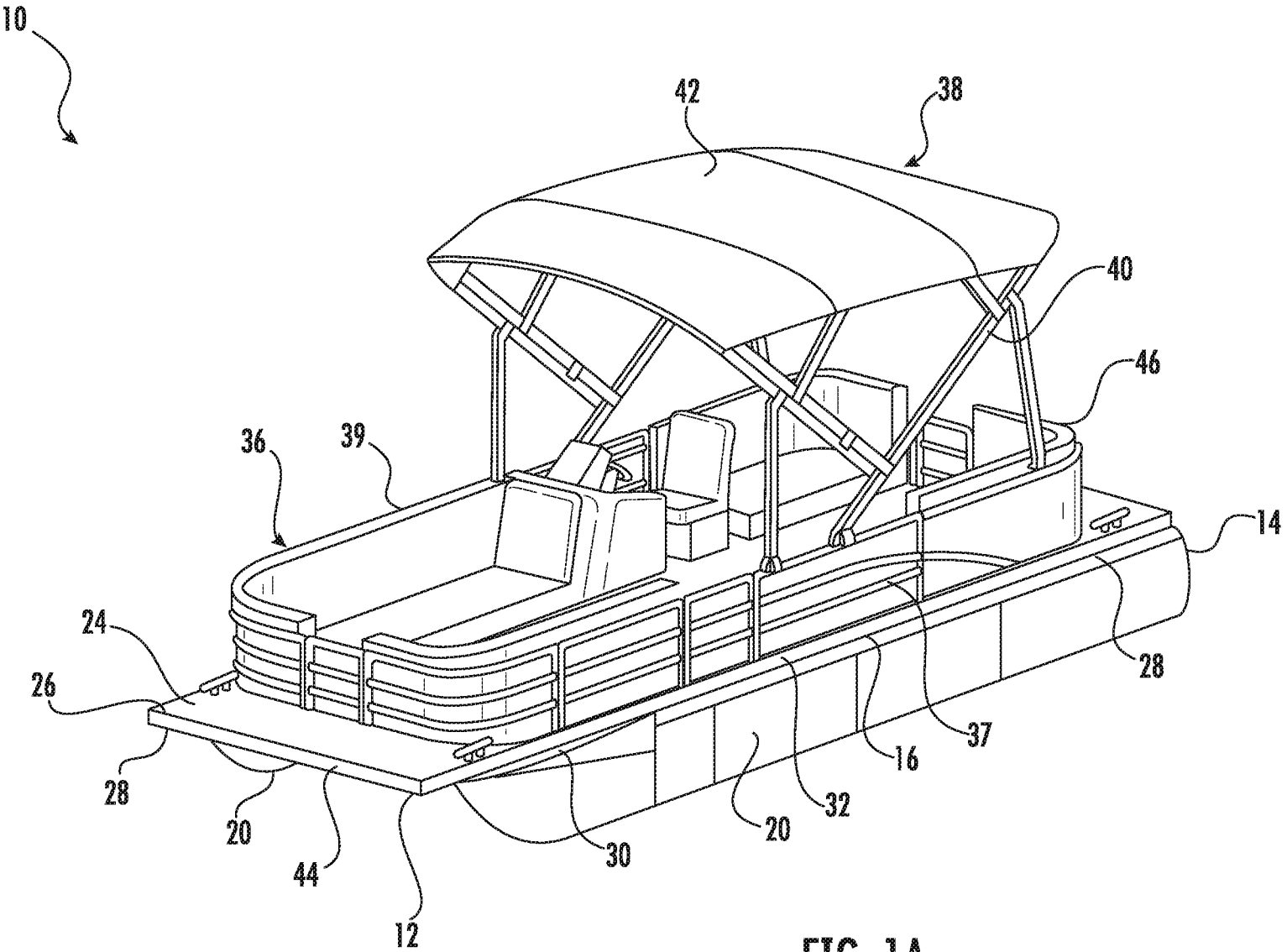
FIG. 1A is side perspective view of an example of a pontoon boat.
Figure 1B:
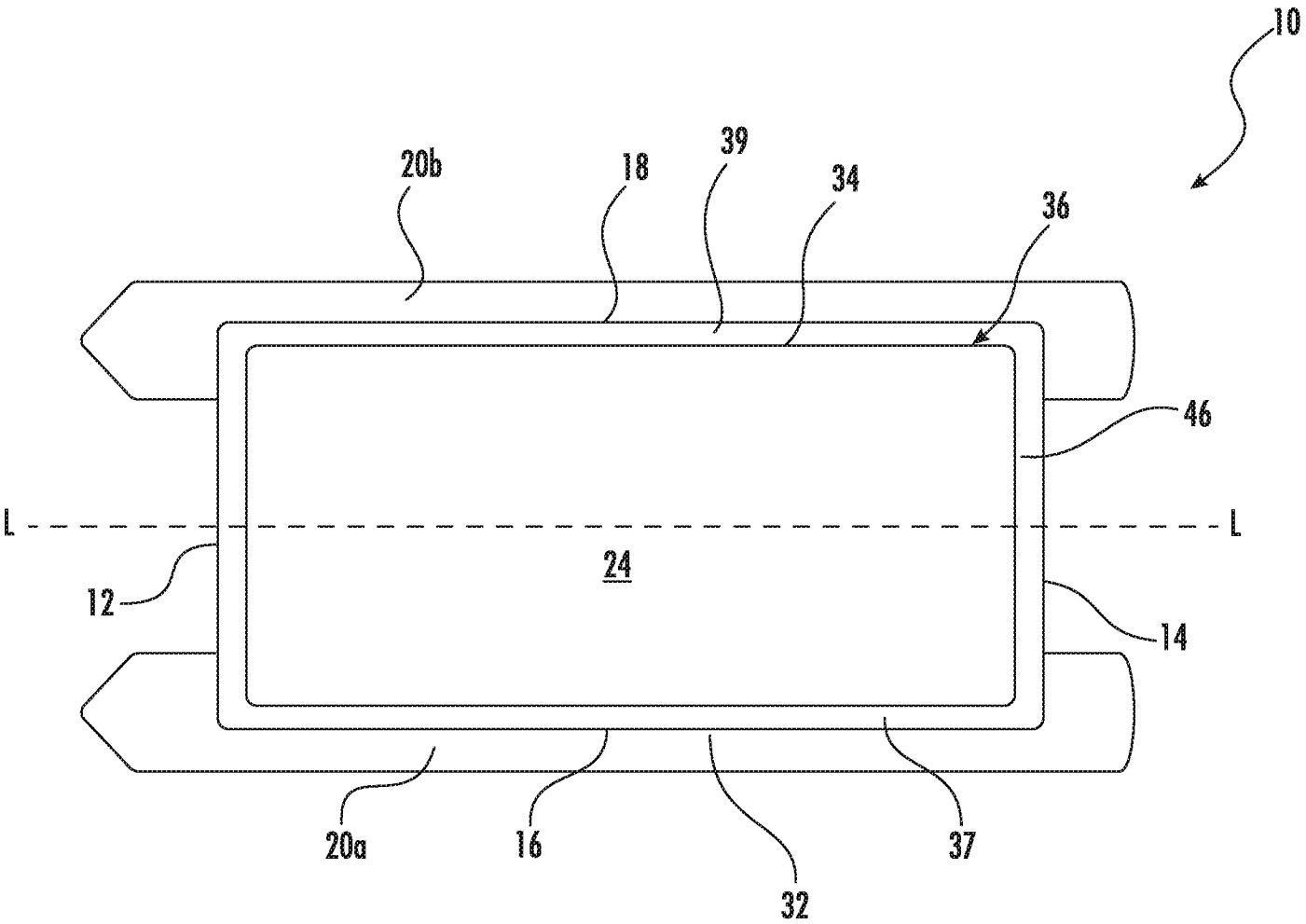
FIG. 1B is a top view of the pontoon boat of FIG. 1A.

With reference now to FIGS. 1A and 1B, an example of a vehicle or watercraft, such as a boat and more specifically a pontoon boat, is illustrated. As shown, the boat 10 includes a hull having a bow or forward portion 12, a stern or aft portion 14, and two opposite lateral sides 16, 18. A longitudinal axis L of the boat 10 extends through a center of the bow 12 and a center of the stern 14. The hull of the boat 10 includes at least one elongated pontoon 20 having a longitudinal axis oriented parallel to the longitudinal axis of the boat 10. In the illustrated, non-limiting embodiment, the boat 10 includes a first pontoon 20*a* adjacent the first lateral side 16 and a second pontoon 20*b* adjacent the second lateral side 18, respectively. Although a boat 10 having two pontoons 20 is illustrated and described herein, it should be understood that a boat 10 having any number of pontoons 20, such as three pontoons, or four pontoons for example, is also within the scope of the disclosure.

The boat 10 additionally includes a generally rectangular deck 24 having a top surface 26 and a bottom surface 28. An upper surface 30 of the at least one pontoon 20 is affixed to the bottom surface 28 of the deck 24. The deck 24 is generally centered about the longitudinal axis L of the boat 10. Further, in an embodiment, a first lateral side 32 of the deck 24 is vertically aligned with the longitudinal axis of an adjacent first pontoon 20*a* and a second lateral side 34 of the deck 24 is vertically aligned with the longitudinal axis of an adjacent second pontoon 20*b*. A railing system 36 is mounted and extends vertically upward from the top surface 26 of the deck 24. The railing system 36 extends about at least a portion of a perimeter of the deck 24, and in some embodiments, about the entire periphery of the deck 24.

In the illustrated, non-limiting embodiment, the boat 10 additionally includes a movable structure 38, such as a bimini, canopy, or marine top for example, mounted to the railing system 36. As shown, the bimini 38 includes a movable frame 40 comprised of a number of structural members that support a piece of material 42. The frame 40 is movable between an extended position in which the bimini 38 provides shade or shelter from the elements over at least a portion of the deck 24, and a collapsed position, in which the bimini 38 is stowed. It should be understood that the boat 10 illustrated and described herein is intended as an example only and that any suitable configuration of a watercraft, including a watercraft that does not include a movable structure 38 for example, is also within the scope of the disclosure.

A cover is typically installed over a portion of a boat 10 to prevent water and other debris from collecting inside the boat 10 when the boat is not in use. With further reference now to FIGS. 2-8, an example of a cover 50 for a boat, such as pontoon boat 10, is illustrated according to an embodiment. As shown, the cover 50 includes a body 52 formed from a fabric, such as canvas or nylon for example, or another suitable weather proof material. In the illustrated, non-limiting embodiment, the cover body 52 is sized to protect the area of the boat 10 defined by the railing system 36. For example, when installed about the boat 10, the cover body 52 extends between the vertical sides 37, 39 and 46 of the railing system 36. Further, an air dam 54 of the cover body 52, which is disposed forwardly in relation to the direction of travel T, may be configured to wrap about a portion of the deck 24 extending beyond the railing system 36. In an embodiment, the air dam 54 of the cover 50 may wrap about a rub rail 43 mounted at the forward section of the deck 24. Alternatively, or in addition, the aft end 56 of the cover body 52 may wrap about a rear end 56 of the railing system 36. Air dam 54 substantially covers the forward section of the boat 10 and wraps around to transition to the front end 86 of arch 84.

As further discussed below, this transition is selectively provided with a transition angle to improve installation while in a mooring. Advantageously, the air dam 54 restricts the flow of air during trailering into the cover body 52.

Figure 2:
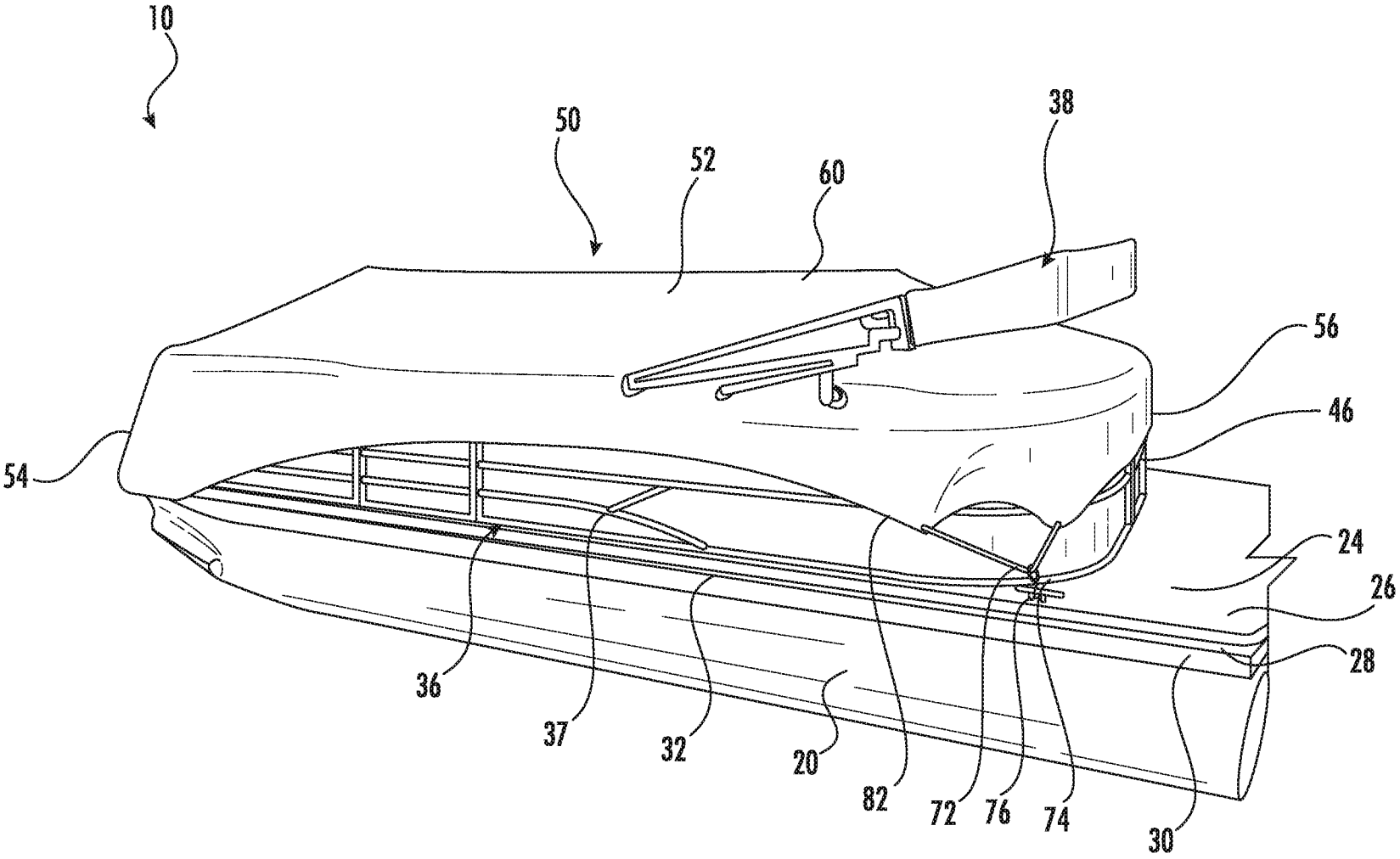
FIG. 2 is a side perspective view of a pontoon boat having a cover assembly affixed thereto according to an embodiment.
Figure 3:
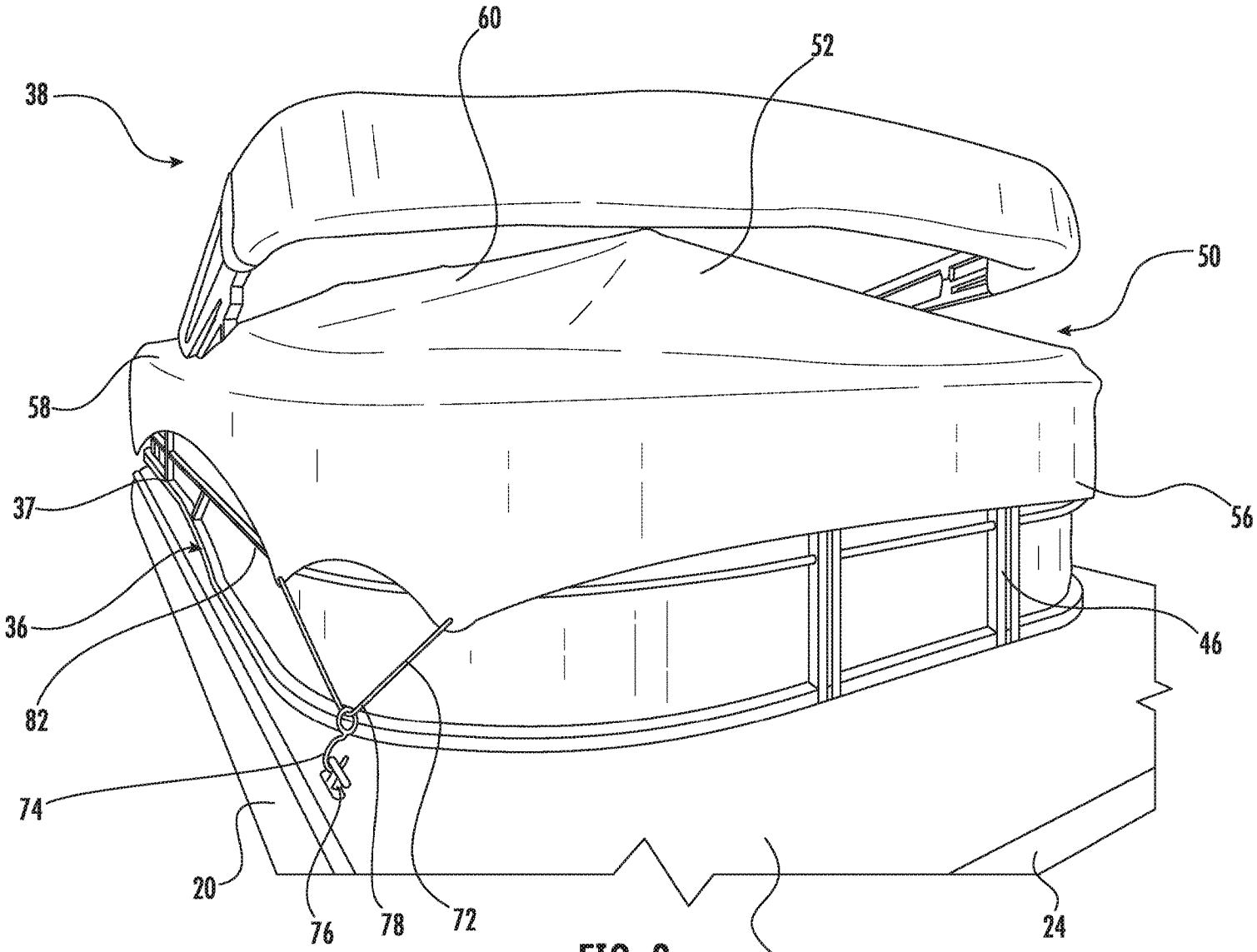
FIG. 3 is a rear perspective view of the pontoon boat of FIG. 2 having a cover assembly affixed thereto according to an embodiment.
Figure 4:
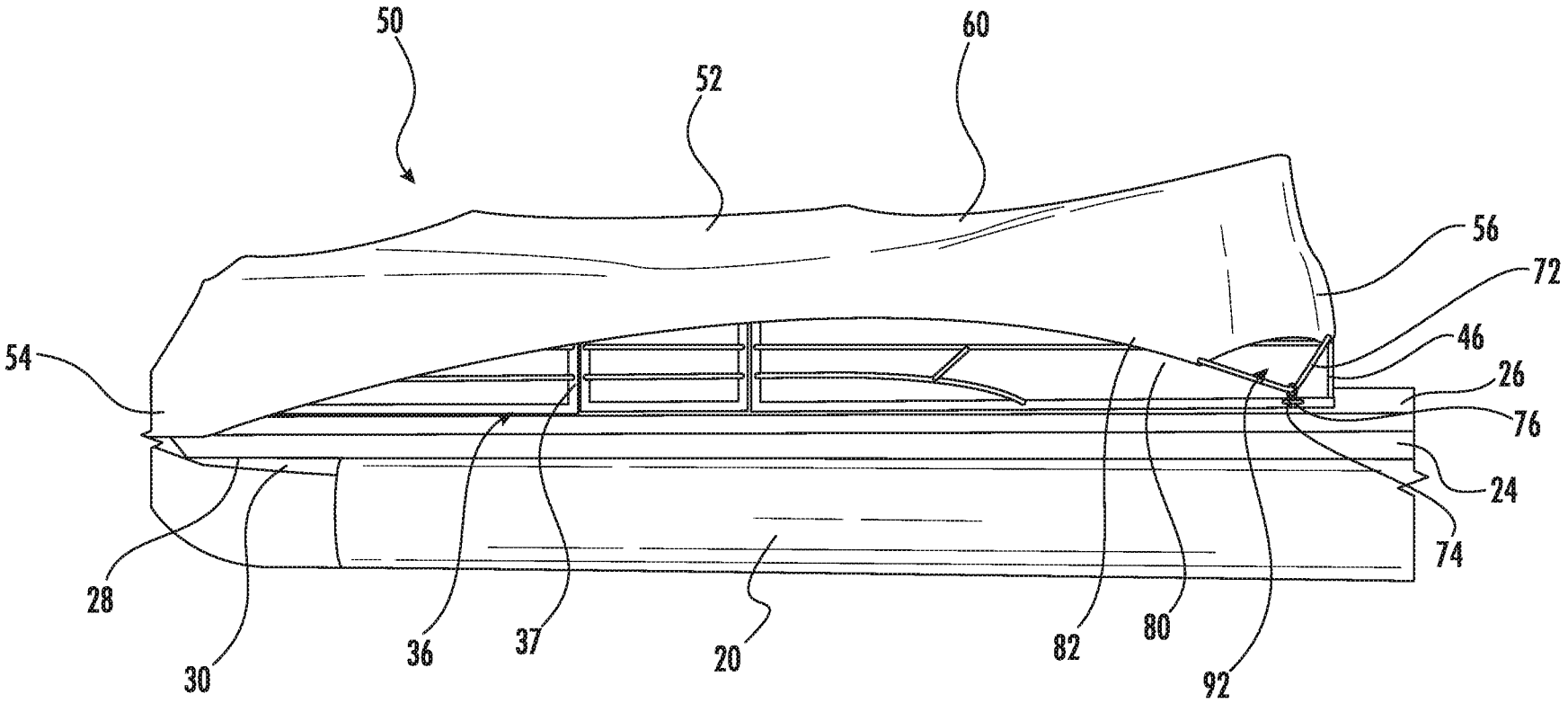
FIG. 4 is a side perspective view of another pontoon boat having a cover assembly affixed thereto according to an embodiment.
Figure 7:
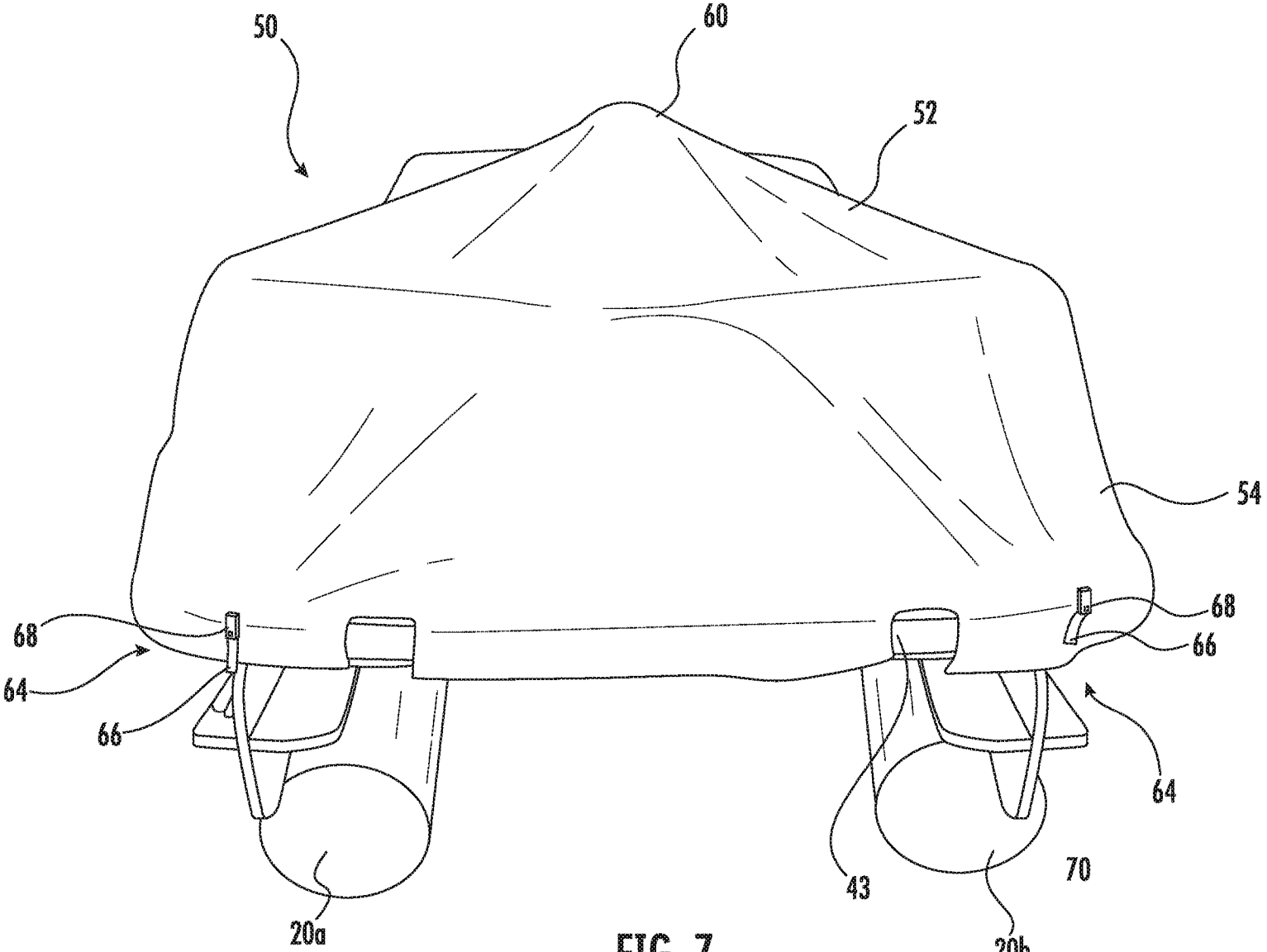
FIG. 7 is a front view of a pontoon boat having a cover assembly affixed thereto in a tightened configuration according to an embodiment.

In an embodiment, shown in FIGS. 2-4, the cover body 52 may be designed with one or more openings 58 through which the movable structure 38 of the boat 10 may extend. In such embodiments, when the cover 50 is affixed to the boat 10, the movable structure 38 is generally in a stowed configuration and is disposed outside of the area protected by the cover 50; for example, as shown, the movable structure 38 is arranged generally adjacent the upper surface 60 of the cover body 52. In other embodiments, the cover body 52 may be designed to protect the movable structure 38 when in the stowed position. As best shown in FIG. 7, in such embodiments, the cover body 52 substantially overlaps the movable structure 38, such that the movable structure 38 is located underneath, and therefore within the area of the boat 10 protected by the cover 50.

Figure 6:
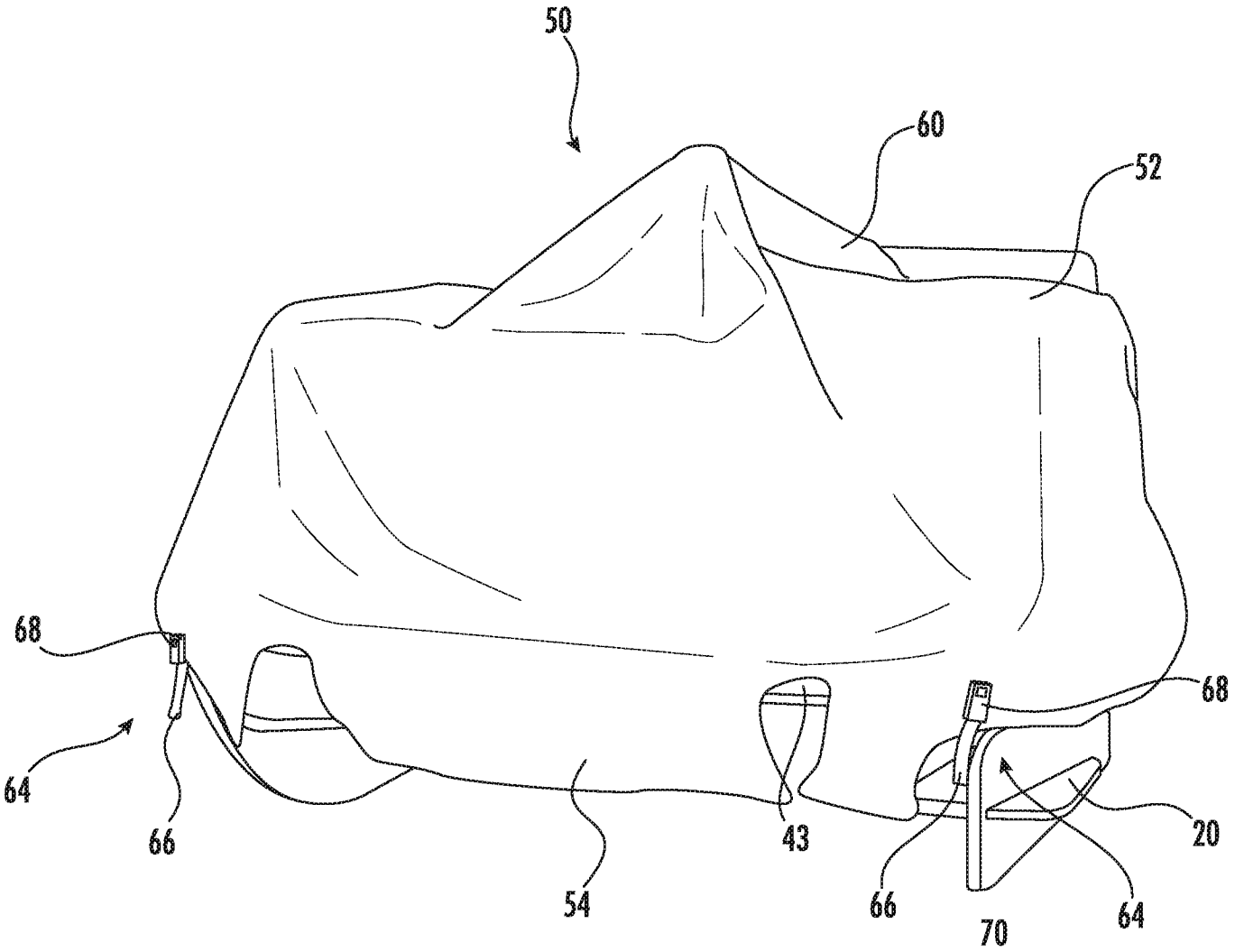
FIG. 6 is a front view of a pontoon boat having a cover assembly affixed thereto in a loose configuration according to an embodiment.

As shown in FIGS. 6 and 7, the cover 50 additionally includes an affixing system for securing the cover body 52 to a portion of the boat 10. When properly installed and tightened, the cover 50 will remain securely in place during trailering of the boat 10, which includes during transport of the boat 10 at speeds commonly associated with travel on a highway. The affixing system may include one or more connectors 64 mounted to the cover body 52, such as adjacent the air dam 54 of the cover body 52, for example. In the illustrated, non-limiting embodiment, the affixing system includes two connectors 64, disposed generally in alignment with the first and second pontoons 20*a* and 20*b*, respectively. Each of the connectors 64 is operable to couple the cover body 52 to an adjacent pontoon 20 to restrict movement of the cover 50 relative to the pontoons 20. However, it should be understood that embodiments having a single connector, more than two connectors, and even no connectors, are also within the scope of the disclosure.

In the illustrated non-limiting embodiment, each of the connectors 64 includes a strap 66 and a buckle 68 for receiving and restricting movement of the strap 66 relative to the cover body 52. To operate the connector 64, a free end of the strap 66 is inserted into a through hole 70 formed at an upper surface of an adjacent pontoon 20 before being connected to the buckle 68. The free end of the strap 66 may be threadably received within the buckle 68, or alternatively, the free end may include one of a male portion and a female portion of a male-female buckle that is removably couplable, such as via a snap fit connection for example, to the other of the male portion and female portion that is affixed to the cover body 52.

As shown in FIGS. 2-4, the affixing system further includes a tension member 72 that extends about a hem of the cover 52. In an embodiment, the hem of the cover body 52 includes one or more pockets (not shown), and the tension member 72 is threaded through the one or more pockets. Although the tension member 72 is illustrated as a piece of webbing or a strap in the FIGS., in other embodiments, the tension member 72 may be a rope, cable, or another suitable member for example.

In an embodiment, the affixing system additionally includes a fastener 74 associated with the tension member 72 located at the hem of the cover body 52. As best shown in FIG. 3, in an embodiment, the fastener 74, such as a hook for example, is slidably connected to a portion of the tension member 72 extending between two pockets of the hem. The fastener 74 is connectable to a fixture of the boat 10, such as a cleat or anchor 76 mounted to the upper surface 26 of the deck 24. Although the cleat 76 is shown adjacent a corner of the stern of the boat 10, the cleat 76 may be located at any suitable position about the boat 10. By connecting the fastener 74 to the cleat 76, the resulting tension applied to the tension member 72 forms an opening 78 in the cover body 52 where the tension member 72 is not encapsulated within the hem of the cover body 52.

Figure 5:
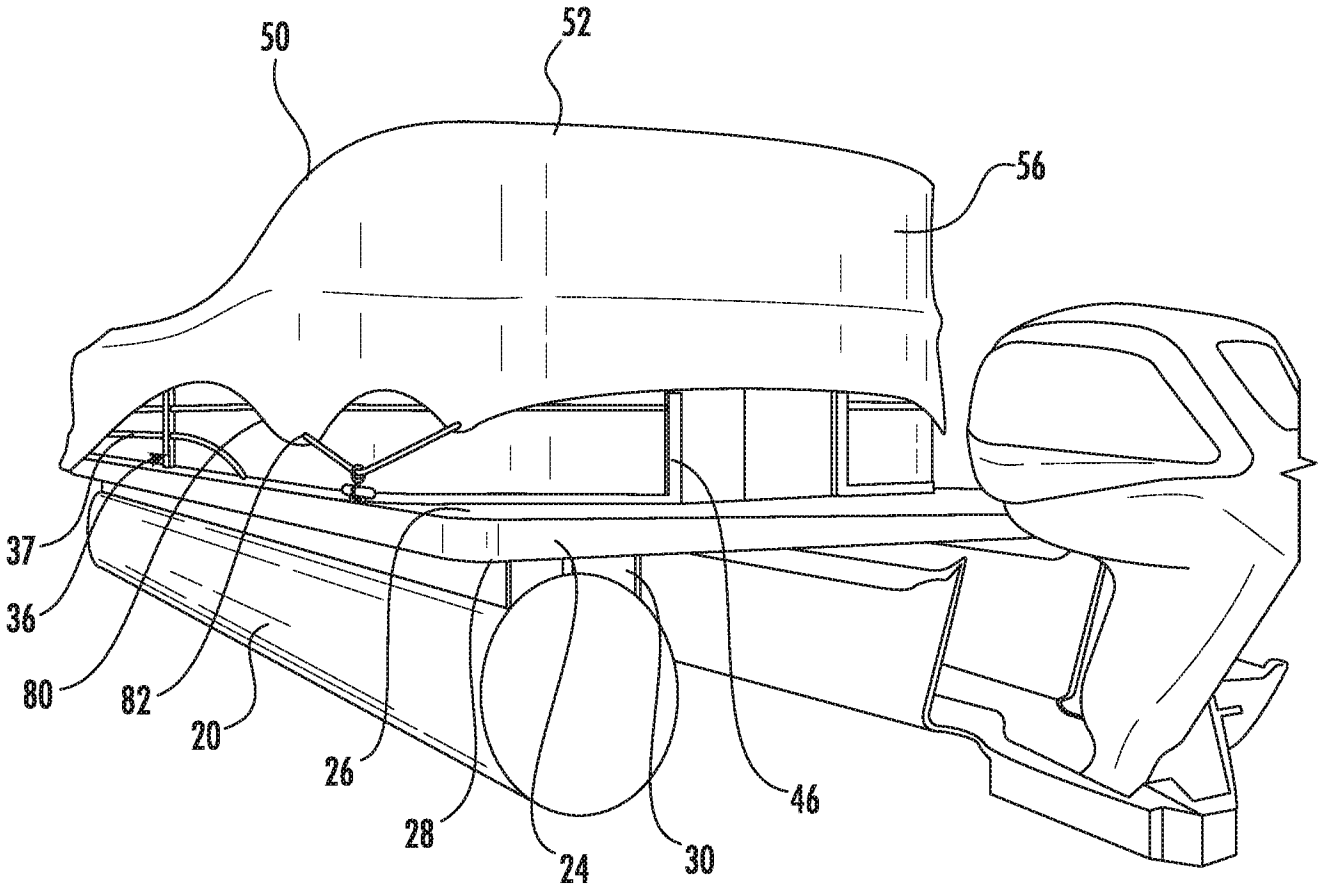
FIG. 5 is a rear perspective view of the pontoon boat of FIG. 4 having a cover assembly affixed thereto according to an embodiment.

A force may be applied to the tension member 72 to selectively tighten the tension member 72, and therefore restrict movement of the cover 50 relative to the boat 10. In an embodiment, a tightening mechanism 80, for example a ratchet, is operably coupled to the tension member 72. However, it should be understood that other suitable tightening mechanisms, such as a winch, gearing, or pulley for example, are also within the scope of the disclosure. As best shown in FIGS. 4 and 5, the tightening mechanism 80 may be accessible via a pocket, an access panel, or a zippered slit 82.

Operation of the tightening mechanism 80 applies a tension to the tension member 72, thereby pulling the cover body 52 taut about the boat 10. In this way, a continuous perimeter strap system is provided that tensions the cover body 52 down over the boat 10. This tension is used to transform the cover body 52 from a loose configuration, as shown in FIG. 6, to a tightened configuration, as shown in FIG. 7. When tension is applied to the cover body 52 and the tension member 72, a large amount of tension will be transferred to the cleat 76, the pontoons 20, the railing system 36, and the rub rail 43. In an embodiment, one or more support poles (not shown) may be positioned on the deck 24 of the boat 10, underneath the cover 50, to support the cover body 52, and prevent water from pooling on the upper surface of the cover body 52.

Figure 8:
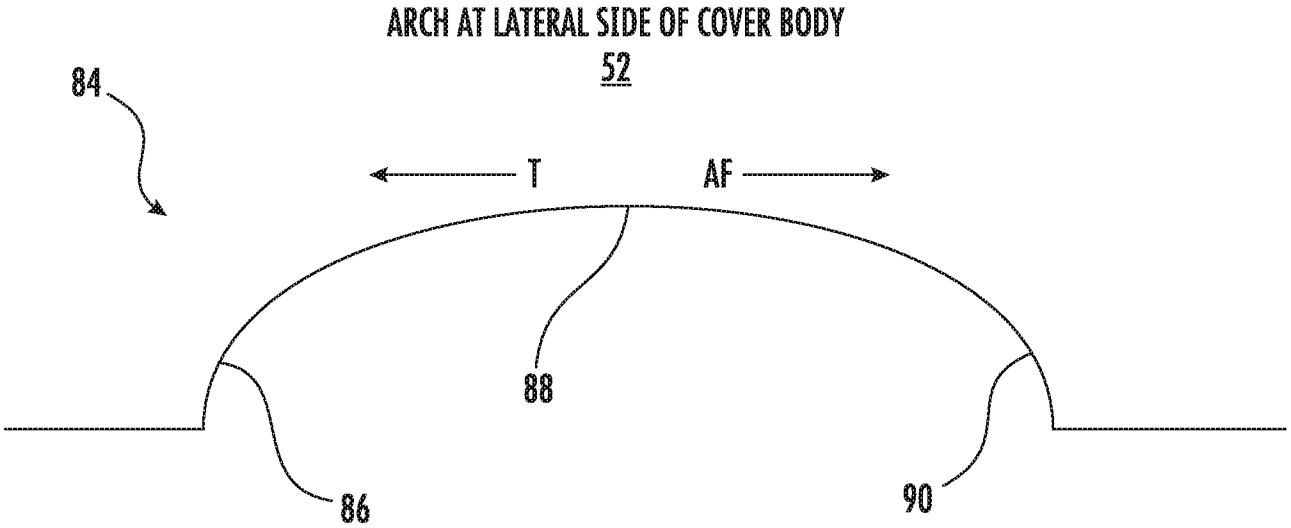
FIG. 8 is a schematic diagram of an arch formed at a lateral side of the cover body according to an embodiment.

The shape of the cover body 52 is important in performance trailering applications. As the boat 10 is transported on a trailer (not shown) in a generally forwards or backwards direction, air flows over and around the cover 50 opposite the direction of travel T from the air dam 54 to the rear end 56. In an embodiment as shown in FIG. 8, the cover body 52 is designed such that when the cover 50 is tightened about the boat 10, one or more sides of the cover body 52 are curved or arched. For example, the contoured sides of the cover body 52, that overlap a portion of the vertical sides 37, 39 of the railing system 36, have a curved or arch-like contour extending generally over the entire side of the cover body 52.

Advantageously, the present design allows the cover body 52 to be trailered by forming a seal, creating a relative lower pressure inside the cover body 52 when compared to the air passing over the large aperture of the front end 86 of the arch 84. The arch 84 has a curve at the front end 86 that is accentuated or greater relative to the curve in the arch 84 in the back 90. The curvature of the front end 86 forms a gap that allows fast moving external air flow to pull air out of the cover body 52. The arch 84 of the back 90 is positioned such that air induced into the leading edge of the back 90 does not enter the cover body 52 and is exhausted through an opening at the back 90.

In an embodiment, the curvature and or radius of the arch 84 in the cover body 52 may vary over the length of the boat 10. In other words, the radius of the arch 84 is non-uniform on a side longitudinal to the direction of air flow AF (opposite travel T). For example, as best shown in FIG. 8, the curvature at the front end 86 of the arch 84, near the bow, is greater than the curvature at the back 90 of the arch 84.

In an embodiment, the air dam 54 of the cover body 52 transitions to the front end 86 of the arch 84 at a transition angle between 25 to 45 degrees. This selected transition angle allows improved installation while in a mooring. The front straps and this transition angle allows the cover body 52 to ratchet in place without having to pull the fabric down over the front corners of the boat 10.

Upwards of one-half of arch 84 comprises the front end 86. Arch 84 may start below the rub rail 43 and sweep up and back toward the center of the cover body 52. There is an air gap between the cover body 52 and the boat 10 created from the structural frame. The air gap allows air to exit as the high volume flow of air passes the air gap.

Also, the front end 86 has a selected radius such that the arch 84 allows air to be removed from the cover. Similarly, the reduced curvature or radius at the back 90 of the arch 84 allows air to pass there through without being drawn into the cover body 52. The arch 84 helps to create a low pressure environment (using the Bernoulli Principle) inside the cover during trailering and further facilitates drawing tension in the cover 50. In addition, the central portion 88 has a radius less than the radius at the back 90 of the arch 84. In particular, central portion 88 is relatively flat or has a near flat arch to minimize air induction.

Also, the cover body 52 may be provided with a rear exhaust port 92 (as shown in FIG. 4) to further aid in the flow of air to facilitate the tensioning of the cover body 52. The back 90 has a smaller radius that dips down to the anchor point 76. Advantageously, the smaller radius limits the amount of air that is induced into the cover body 52. The exhaust port 92 allows what air that gets in through the leading edge of the back 90, to exit out rather than enter the sealed cover body 52.

In an example embodiment, the front end 86 of the arch 84 has a radius between 400 inches to 300 inches. More particularly, between 375 inches to 325 inches. Most particularly, the radius is about 350 inches.

In an example embodiment, the back 90 of the arch 84 has a radius between 100 inches to 50 inches. More particularly, between 88 inches to 62 inches. Most particularly, the radius is about 75 inches.

In an example embodiment, the central portion 88 of the arch 84 has a radius at least greater than 1000 inches.

In an embodiment, the cover 50 may additionally include at least one fixed or movable pressure differential device. Examples of a suitable pressure differential device include those disclosed in U.S. Pat. No. 8,066,318 filed on Sep. 9, 2005, and U.S. patent application Ser. No. 15/200,152, filed on Jul. 1, 2016, the contents of both of which are incorporated herein by reference.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope hereof.

What is claimed is:

1. A cover assembly for a watercraft being transported in an airstream comprising:

a cover body having an front, an aft end, a first lateral side and a second lateral side; and an affixing system operably coupled to the cover body, the affixing system including:

a tension member mounted at a hem of the cover body;

a fastener coupled to the tension member and connectable to a fixture of the watercraft; and a tightening mechanism coupled to the tension member, the tightening mechanism being operable to transform the cover body between a loose configuration and a tightened configuration;

wherein in the tightened configuration, a gap is formed at the first lateral side near the front and an opening is formed at the first lateral side near the aft end, and air is pulled out from an interior of the cover body by a flow of the airstream over said first lateral side.

2. The cover assembly of claim 1, wherein the air pulled out from the interior of the cover body is exhausted with the flow of the airstream through the opening.

3. The cover assembly of claim 1, wherein the gap is configured to extend between the cover body and a portion of the watercraft.

4. The cover assembly of claim 1, wherein in the tightened configuration, a non-uniform arch is formed at the first lateral side, longitudinal to a direction of the airstream.

5. The cover assembly of claim 4, wherein the non-uniform arch includes a front end, a central portion, and a back end, and the gap is formed by a curvature at the front end of the non-uniform arch.

6. The cover assembly of claim 5, wherein the front end includes a first radius, the back end includes a second radius, and the central portion includes a third radius, the first radius, the second radius, and the third radius being different.

7. The cover assembly of claim 6, wherein the first radius is between 400 inches to 300 inches, the second radius is between 100 inches to 50 inches, and the third radius is greater than at least 1000 inches.

8. The cover assembly of claim 1, wherein the front of the cover body includes an air dam configured to wrap about a rub rail of the watercraft, and in the tightened configuration, the air dam is operable to restrict the flow of the airstream into the interior of the cover body.

9. The cover assembly of claim 1, wherein the tension member is a continuous tension strap extending about the front, the aft end, the first lateral side, and the second lateral side of the cover body.

10. The cover assembly of claim 1, wherein the fastener is arranged at a portion of the tension member adjacent to the opening.

11. The cover assembly of claim 1, wherein in the tightened configuration, at least a portion of the cover body is configured to form a seal with a railing of the watercraft.

12. A cover assembly for a watercraft being transported in an airstream comprising:

a cover body having an front, an aft end, and a first lateral side and a second lateral side; and an affixing system operably coupled to the cover body, the affixing system including:

a continuous tension member mounted at a hem of the cover body to the front, the aft end, the first lateral side, and the second lateral side, respectively; and a tightening mechanism coupled to the continuous tension member, the tightening mechanism being operable to transform the cover body between a loose configuration and a tightened configuration;

wherein in the tightened configuration, the continuous tension member applies tension to the front, the aft end, the first lateral side, and the second lateral side of the cover body and a flow of the airstream over the first lateral side is configured to pull air from an interior of the cover body.

13. The cover assembly of claim 12, wherein in the tightened configuration, a gap and an opening are formed at the first lateral side, and the air is pulled out from the interior of the cover body via the gap and is exhausted via the opening.

* * * * *